US007942253B2

(12) United States Patent
Schneeman et al.

(10) Patent No.: US 7,942,253 B2
(45) Date of Patent: May 17, 2011

(54) THUMB-ACTUATED HANDLE DEVICE

(75) Inventors: Brian C. Schneeman, Eldeesburg, MD (US); Scott A. Jones, McMurray, PA (US); Richard W. Woods, Catonsville, MD (US)

(73) Assignee: K2M, Inc., Leesburg, VA (US)

( * ) Notice: Subject to any disclaimer, the term of this patent is extended or adjusted under 35 U.S.C. 154(b) by 784 days.

(21) Appl. No.: 11/438,421

(22) Filed: May 23, 2006

(65) Prior Publication Data

US 2007/0151402 A1 Jul. 5, 2007

(51) Int. Cl.
*B25B 13/46* (2006.01)

(52) U.S. Cl. ..... 192/43.2; 81/63.1

(58) Field of Classification Search ..... 81/52, 58, 81/63.1; 192/43.2
See application file for complete search history.

(56) References Cited

U.S. PATENT DOCUMENTS

| | | | | | |
|---|---|---|---|---|---|
| 304,102 | A * | 8/1884 | Hermann | 81/30 |
| 309,876 | A * | 12/1884 | Reising | 81/33 |
| 813,586 | A * | 2/1906 | Richards | 81/33 |
| 878,657 | A * | 2/1908 | Munch | 81/59.1 |
| 1,897,854 | A * | 2/1933 | Merl et. al. | 192/43.2 |
| 2,826,107 | A * | 3/1958 | Woods | 81/480 |
| 3,136,346 | A * | 6/1964 | Karl et. al. | 81/58.3 |
| 4,285,375 | A * | 8/1981 | Judson | 81/30 |
| 4,597,478 | A * | 7/1986 | Bodnar | 192/43.1 |
| 4,777,852 | A | 10/1988 | Herman et al. | |
| 4,793,222 | A * | 12/1988 | Beugelsdyk | 81/63.1 |
| 5,437,212 | A | 8/1995 | Thompson et al. | |
| 5,461,950 | A * | 10/1995 | Iwinski | 81/61 |
| 5,520,073 | A * | 5/1996 | Bakula et al. | 81/63.1 |
| 5,613,585 | A | 3/1997 | Tiede | |
| 5,619,891 | A | 4/1997 | Tiede | |
| 6,898,998 | B2 * | 5/2005 | Shyu | 81/63.1 |
| 7,063,703 | B2 * | 6/2006 | Reo | 606/79 |
| 7,100,888 | B1 * | 9/2006 | Johnson | 251/93 |

* cited by examiner

*Primary Examiner* — Richard M Lorence

(74) *Attorney, Agent, or Firm* — Carter, DeLuca, Farrell & Schmidt, LLP

(57) ABSTRACT

Provided is a novel handle device that encloses a ratcheting mechanism that a user can easily control and operate using only one hand by employing conveniently located push button ratchet controls situated at the opposing lateral surface ends of the handle.

13 Claims, 2 Drawing Sheets

THUMB-ACTUATED HANDLE DEVICE

BACKGROUND OF THE INVENTION

1. Field of the Invention

The present invention relates to a novel handle device containing a ratcheting mechanism. More particularly, the present invention relates to a novel handle device that encloses a ratcheting mechanism that a user can easily control and operate using only one hand by employing conveniently located push button ratchet controls.

2. Background of the Technology

Ratcheting hand operated devices, such as screw drivers are well known in the art. Conventional ratcheting handles are operated by the user employing one hand to hold the handle in place and using the other hand to turn an actuating mechanism that serves to select one or the other of two pawls to engage with a ratchet gear contained within the handle and operationally connected to a shaft and the screw driver bit or the like.

An example of such conventional handles with ratcheting mechanisms is found in U.S. Pat. No. 4,777,852, which discloses a somewhat complicated lever system to selectively actuate two spaced-apart pawls for their alternate engagement with a gear so as to produce the desired ratcheting action in either direction.

Other conventional ratchet equipped handles are found in U.S. Pat. No. 5,619,891; U.S. Pat. No. 5,613,585; and U.S. Pat. No. 5,437,212, which build on other much earlier patents that employ pivotally mounted pawls that are commonly actuated by a turning or twisting mechanism to bring the gears of one or the other of two pawls into engagement with a ratchet gear.

Common to the conventional ratchet equipped handles, rather lever or pivotally actuated, is the requirement that the user must use one hand to securely steady the handle and use the other hand to select the desired action for the ratchet mechanism. This is particularly inconvenient when such ratchet equipped handles are used to loosen or tighten a surgical or implanted device used in a subject during a surgical procedure, such as an orthopedic procedure.

Thus, a need exists to provide a handle having a ratcheting mechanism that can be selected and actuated with ease by the user with the need to use only one hand in the process.

SUMMARY OF THE INVENTION

The handle device of the present invention provides a novel handle assembly having an internally disposed ratcheting mechanism for driving an operating shaft, the selection and operation of the ratcheting mechanism requiring the use of only one hand.

Also provided is a ratcheting handle device employing push buttons to select the mode of operation of the ratcheting mechanism using the same hand as used to grasp and secure the handle device during operation.

Also provided is a method of operation of a ratcheting handle device wherein the user requires only the use of one hand to both select the mode of operation of the ratcheting mechanism and to grasp and secure the handle device.

Also provided is a kit that includes a novel handle device having an internally disposed ratcheting mechanism for driving an operating shaft, the selection and operation of the ratcheting mechanism requiring the use of only one hand and at least one associated tool or instrument capable of operable connection to the handle device.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILED DESCRIPTION OF THE INVENTION

Figure 2:
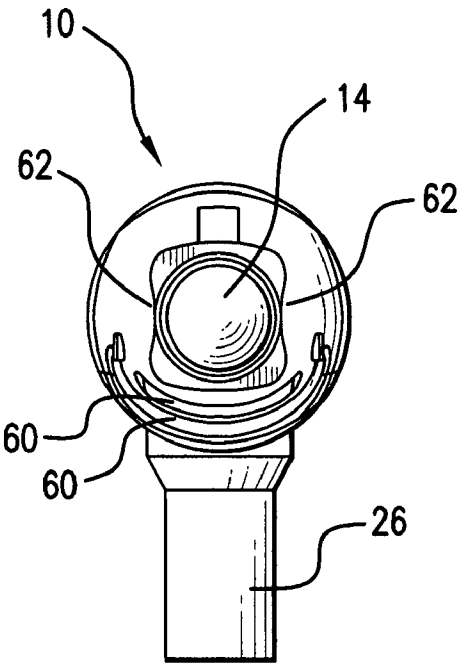
FIG. 2 shows an end view of the handle device of the present invention shown in FIG. 1.

Detailed embodiments of the present invention are disclosed herein; however, it is understood that the following description is provided as being exemplary of the invention, which may be embodied in various forms without departing from the scope of the claimed invention. Thus, the specific structural and functional details provided in the description are non-limiting, but serve merely as a basis for the invention defined by the claims provided herewith.

The exemplary embodiment of the novel handle device, as shown in FIGS. 1-4, has a T-handle configuration but the device can have any external conformation consistent with ease of manual use without departing from the concept of the invention. Contained within the handle device is a ratcheting assembly, generally shown at 12, that a user can easily control and operate using only one hand by employing conveniently located first and second push button ratchet controls 14, 16. As best shown in FIGS. 1-4, the exemplary T-handle device 10 of the present invention is configured and contoured to comfortably fit into the hand of a user and in particular to provide a first push button ratchet control 14 and a second push button ratchet control 16, which are respectively positioned at a first end 18 and a second end 20 of a cross-member portion 22 of the T-handle device 10.

Figure 1:
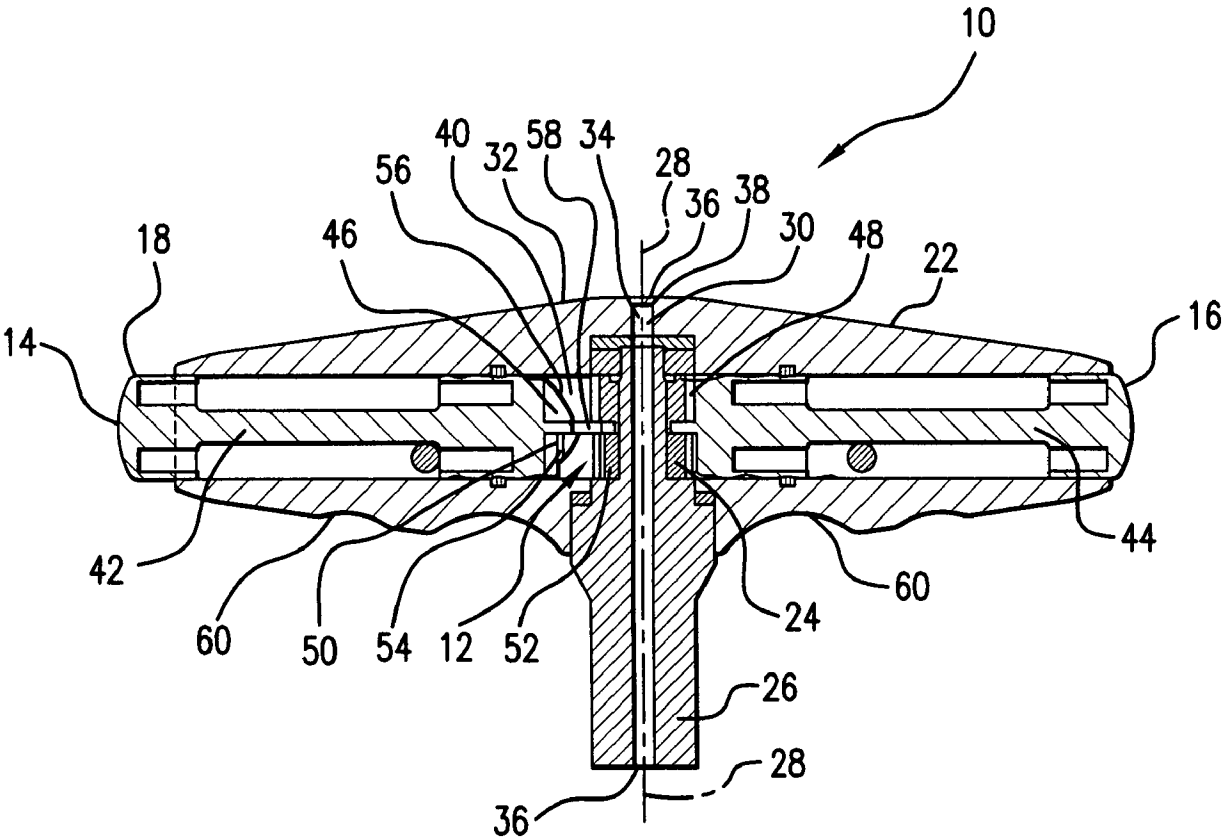
FIG. 1 shows a cross-sectional front view of an exemplary embodiment of the handle device of the present invention.

As best shown in FIG. 1, the ratcheting assembly 12 includes a tubular ratchet gear 24 that is circumferentially attached around a torque transmission shaft 26 that extends from within the T-handle device 10 downward and out along the upright axis 28 of the T-handle device 10. The tubular ratchet gear 24 is preferably fixedly attached to the shaft 26. However, it is within the concept of the present invention that the T-handle device 10 can be constructed so as to be dismantled and reassembled with removable and replaceable components and, in such an alternative embodiment, the tubular ratchet gear 24, as with other components could be configured to be securely but removably attached to the shaft 26.

The ratchet gear 24 and shaft 26 occupy a circumferential portion of a vertical axis core 30, which is defined by the handle body 32 of the T-handle device 10. A central passage 34 extending from an upper access port 36, is defined along the upright axis of the T-handle 28 through the entire length of the shaft 26. The central passage 34 thus provides a vertical passage through the T-handle device 10, through which other instruments, devices, and materials can be passed if desired.

The upper access port 36, which provides access to the central passage 34 can be permanently or removably blocked by an access port block 38.

At an approximately right angle to the upright axis of the T-handle 28 is a cross-member shaft 40, which passes the entire length of the cross member portion 22. A central portion of the cross-member shaft 40 is aligned so as to intersect the vertical axis core 30 and to be spatially connected therewith; such that the handle body 32 defines a T-shaped internal hollow portion. As shown in FIG. 1 and discussed above, the vertical axis core 30 portion of this internal hollow portion is primarily occupied by the ratchet assembly 12 and the operationally connected shaft 26.

On opposing sides of the ratchet assembly 12 and extending respectively from the first end 18 and second end 20 of the cross-member portion is the first actuator assembly 42 and a second actuator assembly 44. Connected outermost or lateral to the ratchet assembly 12 on each of the first actuator assembly 42 and the second actuator assembly 44 is respectively the first push button ratchet control 14 and the second push button ratchet control 16, which extend outside of the handle body 32. Connected innermost or medial to the ratchet assembly 12 on each of the first actuator assembly 42 and the second actuator assembly 44 is respectively a first pawl 46 and a second pawl 48. Each of the first pawl 46 and second pawl 48 is provided with actuator gear teeth 50 that are complementary to the ratchet gear teeth 52 on the circumference of the tubular ratchet gear 24. As is well known in the art, the ratchet gear teeth can have an engaging surface 54 and a camming surface 56.

The first pawl 46 actuator gear teeth 50 are positioned such that when the first push button control 14 is moved inward toward the ratchet assembly 12 by a user, the engaging surface 54 of the gear teeth 50 makes engaging contact with the tubular ratchet gear teeth 52. The configuration of the engaging surface 54 of the actuator gear teeth 50, which are engaged with the ratchet gear teeth 52 is such that when engagement takes place and the handle body 32 is turned in a clockwise direction, the handle body 32 and the ratchet gear 24 will turn together in a clockwise manner. Such clockwise movement would, when transmitted by the ratchet gear 24 to the shaft 26, have the effect of providing a clockwise driving or tightening force for any drill or tool, and any associated screw or fastener that is operationally connected to the shaft 24. Conversely, because of the configuration of the camming surface 56 of the same actuator gear teeth, a counter-clockwise rotation will not result in engagement with the ratchet gear 24 and the ratcheting effect will occur without removing or loosening any tool or associated screw or fastener connected to the shaft 24.

When the second push button ratchet control 16 is pushed inward by a user, the engaging surface 54 of the actuator gear teeth 50 for the pawl associated with the second push button ratchet control 16 will produce just the opposite effect on the ratchet gear 24 and any drill, or tool and any associated screw or fastener connected thereto via the shaft 24. Thus, when the second push button ratchet control 16 is pushed inward, the engaging surface will engage and move with the ratchet gear 24 only when the handle body 32 is moved in a counter-clockwise direction. Movement of the handle in a counter-clockwise direction, by convention, will effect to remove, or loosen any drill or tool and any associated screw or fastener effected thereby. Similarly, if a clockwise movement of the handle were made while the second push button ratchet control 16 is pushed inward to engage the actuator gear teeth 50, a camming effect would result and no clockwise handle body 32 movement would result in a corresponding movement of the ratchet gear 24.

A push button attachment member 58 connects the first push button ratchet control 14 to the second push button ratchet control 16 bypassing the ratchet gear 24. Any inward motion of the first push button ratchet control 14 is transmitted by the push button attachment member 58 to the second push button control 16 so as to force the second push button control 18 outward and away from the ratchet gear. By this attachment member 58, the user is unable to engage the first pawl 46 and the second pawl simultaneously.

Figure 3:
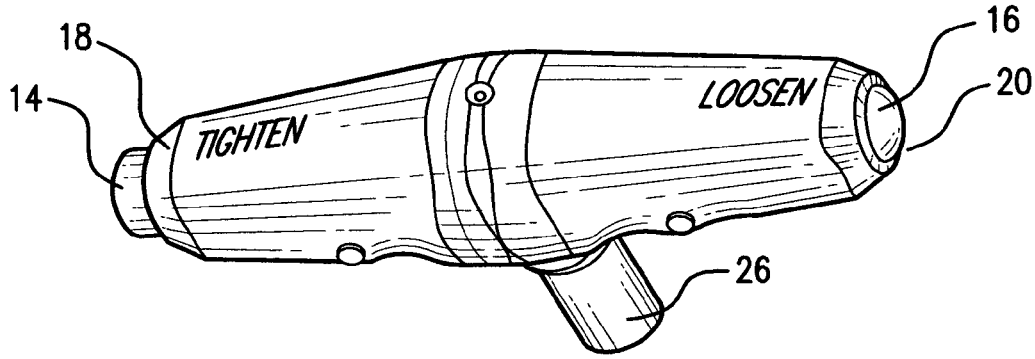
FIG. 3 shows a superior perspective view of the handle device shown in FIG. 1.

The handle body 32 can be prominently marked on the first end 18 of the cross member portion 22 to indicate the operational function selected when the first push button ratchet control 14 is selected. Non limiting examples of indicia that can be placed on the handle adjacent to the first push button 14 are "clockwise," or "drive," or, as shown in FIG. 3, "tighten" or the like. Similarly, the second end 20 can be marked to indicate the operational function of the second push button ratchet control 16, which is to remove or loosen an associated drill or tool by its counter-clockwise rotation. As best shown in FIG. 3, such marking is preferably accomplished by applying visible marking such as words to the handle body 32, such as "tighten" or "loosen." Other marking methods such as single printed letters, raised letters, protrusions, indentations, or other visual or tactile markings can be used without departing from the concept of the invention. The handle body 32 can also be contoured to include finger grooves 60 as shown in FIGS. 1-4 to provide an ergonomically designed handle for ease and comfort of use as well as improved grip by the user. As best shown in FIG. 2, a thumb cradle or saddle 62 can be contoured into the handle body 32 to facilitate its application of manual pressure from a user's thumb when moving either first or second push button ratchet control 14, 16 inward.

Figure 4:
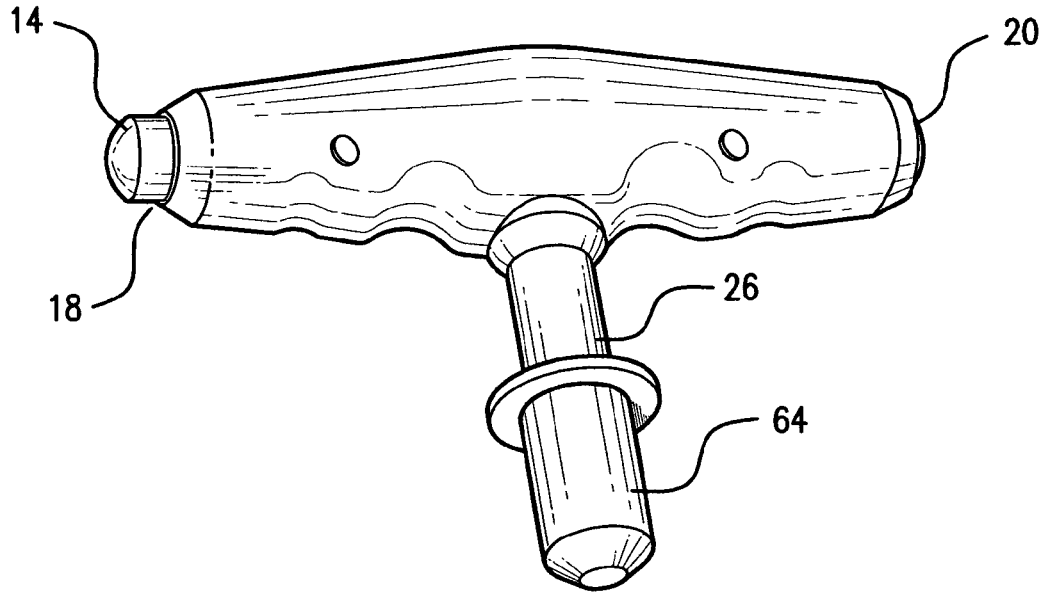
FIG. 4 shows an inferior perspective view of the handle device shown in FIG. 1.

As best shown in FIG. 4, in operation the shaft 26 of the T-handle device 10 can be releasably attached to an instrument or tool by a shaft connector assembly 64. A preferred shaft connector assembly 64 is a quick disconnect device as is well known in the art; although, any connection assembly, such as, for example a bayonet connector, screw connector, luer lock type connector, friction fit connectors, snap fit connectors, and the like, can be used with the claimed handle device without departing from the intended scope of the invention when assembled with an instrument. Alternatively, a tool or instrument can be directly attached to the torque transmission shaft 26. Such alternative attachment can be permanently attached or releasably attached without departing from the concept of the invention.

Each of the embodiments described above are provided for illustrative purposes only and it is within the concept of the present invention to include modifications and varying configurations without departing from the scope of the invention that is limited only by the claims included herewith.

What is claimed is:

1. A novel handle device comprising:

a handle body defining a vertical axis core and a spatially connected cross member shaft, said handle body having a T-handle body configuration and defining a central passage along a vertical axis of said handle device through said T-handle body and through a torque transmission operating shaft, said central passage being sized so as to permit selective passage of instruments or materials through said handle device, a ratcheting mechanism having opposing pawls, each pawl having engaging teeth and camming surfaces, said ratcheting mechanism being contained within said T-handle body and operationally connected to the exterior of a first and a second lateral surface end of said handle body by a respective first and second actuator assembly, said respective first and second actuator assemblies being connected to each other by a push button attachment member and being slidably disposed within said cross member shaft on opposing sides of said vertical axis core, said first and second actuator assemblies each being connected at one end to said ratcheting mechanism and at a second end to a respective first control button or a second control button located at least partially external to said respective first lateral surface end and second lateral surface end of said T-handle body, wherein any inward motion of one of said first or second actuator assemblies causes an outward motion of the other of said first or second actuator assemblies, said operating shaft being rotationally contained with said vertical axis core and comprising a ratchet gear, said ratchet gear having engaging teeth of complementary configuration to said engaging teeth of said opposing pawls and being circumferentially connected around a portion of said operating shaft, wherein manual selection of said first or second control buttons can by movement of said push button attachment member effect slidable movement of said first actuator or second actuator assembly within said cross member shaft so as to force mutually exclusive mechanical engagement of one of said opposing pawls of said ratcheting mechanism with said ratchet gear on a respective first or a second side of said operating shaft, said mechanical engagement being capable of selectively transferring torque applied to said T-handle body to said operating shaft of said device to effect a clockwise or counter-clockwise rotational force transfer mode of said device.

2. The handle device of claim 1, wherein said pawl engaging teeth are configured upon movement of said first or said second control button to selectively engage said ratchet gear engaging teeth so as to operationally transmit any torque applied to said T-handle body to said ratchet gear and said camming surfaces being configured to permit slippage of said pawl over said ratchet gear engaging teeth when said opposite direction torque is applied to said T-handle body.

3. The handle device of claim 2, wherein selective movement of said first control button or said second control button can effect a torque transfer from said T-handle body via said ratcheting mechanism to said operating shaft so as to select a clockwise or counter-clockwise operating mode for said handle device.

4. The handle device of claim 1, wherein said handle device is operable by a user using only one hand to hold said T-handle body and to selectively actuate said ratcheting mechanism alternatively using said first or second control buttons.

5. The handle device according to claim 1, wherein said inward movement of said first control button is mechanically transmitted from the first button to said first actuating member and via said push button attachment member to said second actuating member so as to effect an outward movement of said second control button, whereby said selection of said first control button is mutually exclusive of selection of said second control button.

6. The handle device according to claim 5, wherein said first button movement can engage said ratcheting mechanism to effect a clockwise driving or tightening mode of said handle device while simultaneously disengaging said second button and said second actuating member and associated removing or loosening mode of said ratcheting mechanism.

7. The handle device of claim 6, wherein said first button can be selected to effect movement of said first actuating member and engagement of said first pawl so as to permit clockwise rotational engagement of said ratcheting mechanism and said operating shaft.

8. The handle device of claim 6, wherein said second button can be selected to effect movement of said second actuating member and engagement of said second pawl so as to permit counter-clockwise rotational engagement of said ratcheting mechanism and said operating shaft.

9. The handle device according to claim 1, wherein said central passage defines an access port at the top exterior portion of said T-handle body.

10. The handle device according to claim 9, further comprising an access port block sized and configured to close said access port.

11. The handle device according to claim 10, wherein said access port block can be selectively inserted into or removed from said access port.

12. The handle device according to claim 1, further comprising a shaft connector assembly connected to said operating shaft located below said T-handle body and configured to connect said operating shaft to a selected instrument.

13. The handle device according to claim 12, wherein said connector assembly is selected from the group of connectors consisting of quick disconnect connectors, bayonet type connectors, screw-type connectors, friction fit connectors, luer lock type connectors, and snap fit connectors.

* * * * *